US007256163B2

(12) United States Patent
Akada et al.

(10) Patent No.: US 7,256,163 B2
(45) Date of Patent: Aug. 14, 2007

(54) GREASE COMPOSITION

(75) Inventors: Tamio Akada, Kobe (JP); Akihiko Kominami, Takarazuka (JP); Mitsuru Kishimoto, Takarazuka (JP); Akira Kohno, Nishinomiya (JP); Hirotsugu Kinoshita, Yokohama (JP); Souichi Nomura, Tokyo (JP); Takashi Arai, Yokohama (JP); Kiyomi Sakamoto, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 441 days.

(21) Appl. No.: 10/300,882

(22) Filed: Nov. 21, 2002

(65) Prior Publication Data

US 2003/0139302 A1 Jul. 24, 2003

(30) Foreign Application Priority Data

Nov. 21, 2001 (JP) ..... P2001-356664

(51) Int. Cl.
*C10M 169/06* (2006.01)

(52) U.S. Cl. ..... 508/460; 508/462; 508/539; 508/567

(58) Field of Classification Search ..... 508/460
See application file for complete search history.

(56) References Cited

U.S. PATENT DOCUMENTS 3,746,643 A * 7/1973 Rogers ..... 508/391
4,308,182 A 12/1981 Eckard et al.
4,824,585 A * 4/1989 Marotel et al. ..... 508/460
4,830,767 A * 5/1989 Waynick ..... 508/163
4,902,435 A * 2/1990 Waynick ..... 508/163
4,929,371 A * 5/1990 Waynick ..... 508/159
4,986,923 A 1/1991 Waynick
5,084,193 A * 1/1992 Waynick ..... 508/528
5,096,605 A * 3/1992 Waynick ..... 508/163
5,102,565 A 4/1992 Waynick
5,385,682 A 1/1995 Hutchings
5,501,807 A * 3/1996 Benda et al. ..... 508/460
5,589,444 A * 12/1996 Hatakeyama ..... 508/168
5,952,273 A 9/1999 Suzuki et al.
6,037,314 A * 3/2000 Kondo et al. ..... 508/363
6,432,889 B1 * 8/2002 Kinoshita et al. ..... 508/399

FOREIGN PATENT DOCUMENTS

| | | |
|---|---|---|
| JP | 06-500579 | 1/1994 |
| JP | 11-269478 | 10/1999 |
| JP | 2003-013083 | 1/2003 |
| WO | WO 91/18076 | 11/1991 |

* cited by examiner

*Primary Examiner*—Ellen M. McAvoy
(74) *Attorney, Agent, or Firm*—Finnegan, Henderson, Farabow, Garrett, & Dunner, L.L.P.

(57) ABSTRACT

The grease composition of the present invention contains, in a lubricant base oil, 0.01 to 10% by mass of a fatty acid salt, 0.01 to 10% by mass of carbonate, 2 to 30% by mass of a thickener, and 0.1 to 20% by mass of a sulfur type extreme-pressure agent on the basis of the total amount of composition.

3 Claims, No Drawings

GREASE COMPOSITION

BACKGROUND OF THE INVENTION

1. Field of the Invention

The present invention relates to a grease composition and, more specifically, to a grease composition used in a constant velocity joint and the like.

2. Related Background Art

Constant velocity joints are joints for a shaft transmitting a driving force from a transmission of a car to its tires, for example. Their types include fixed type constant velocity joints such as Barfield joint, Rzeppa joint, and undercutting free joint; slide type constant velocity joints such as double-offset joint, tripod joint, and cross-groove joint; and the like.

For achieving a longer life in these constant velocity joints, the selection of grease is very important. Therefore, conventional constant velocity joints have widely employed a grease in which an additive such as a lead compound is compounded with a base grease comprising a lubricant base oil and lithium soap or urea type thickener, thereby improving such performances as anti-flaking, anti-seizure, anti-wear, low friction, and the like.

SUMMARY OF THE INVENTION

However, along with cars achieving higher performances, smaller size, and lighter weight in recent years, the load on constant velocity joints has been increasing, whereby there are cases where the conventional greases fail to elongate the life sufficiently. In particular, it is quite difficult to prevent flaking or seizure from occurring under such a severe condition, thus yielding a strong demand for a grease which is excellent in anti-flaking and anti-seizure. In this case, from the viewpoint of safety with respect to the human body and environment, it is desirable that characteristics of greases be improved without using lead compounds which have conventionally been used as additives.

In view of the foregoing problems of prior art, it is an object of the present invention to provide a grease composition achieving a high level of anti-flaking and anti-seizure without using lead compounds, and being capable of sufficiently elongating the life of a constant velocity joint or the like.

The inventors conducted diligent studies in order to achieve the above-mentioned object and, as a result, have found that a grease composition in which a thickener, a sulfur type extreme-pressure agent, and a fatty acid salt over based by a carbonate are compounded by their respective predetermined ratios with a lubricant base oil exhibits quite excellent anti-flaking and anti-seizure in constant velocity joints and the like, thereby accomplishing the present invention.

Namely, the grease composition of the present invention contains, in (A) a lubricant base oil, (B) 0.01 to 10% by mass of a fatty acid salt, (C) 0.01 to 10% by mass of a carbonate, (D) 2 to 30% by mass of a thickener, and (E) 0.1 to 20% by mass of a sulfur type extreme-pressure agent on the basis of the total amount of the composition.

DESCRIPTION OF THE PREFERRED EMBODIMENTS

In the following, preferred embodiments of the present invention will be explained in detail.

Examples of the (A) lubricant base oil used in the grease composition of the present invention include mineral oils and/or synthetic oils.

Such mineral oils include those obtained by methods normally carried out in lubricant oil making processes in petroleum refineries, e.g., those refined by subjecting a lubricant fraction obtained by atmospheric distillation or vacuum distillation of crude oils to at least one of treatments such as solvent deasphalting, solvent extraction, hydrocracking, solvent dewaxing, catalytic dewaxing, hydrogenation refining, sulfuric acid washing, clay treatment, and the like.

Specific examples of the synthetic oils include poly α-olefines such as polybutene, 1-octene olygomer, and 1-deceneolygomer, and their hydrogenated products; diesters such as ditridecyl glutarate, di-2-ethylhexyl adipate, diisodecyl adipate, ditridecyl adipate, and di-3-ethylhexyl cebacate; polyol esters such as trimethylolpropane caprylate, trimethylolpropane pelargonate, pentaerythritol 2-ethylhexanoate, and pentaerythritol pelargonate; alkyl naphthalene; alkyl benzene; polyoxyalkylene glycol; polyphenyl ether; dialkyldiphenyl ether; silicone oil; and their mixtures.

The kinematic viscosity of the lubricant base oil at 100° C. is preferably 2 to 40 $mm^2/s$, more preferably 3 to 20 $mm^2/s$. The viscosity index of the base oil is preferably at least 90, more preferably at least 100.

In the present invention, (B) 0.01 to 10% by mass of a fatty acid salt, (C) 0.01 to 10% by mass of a carbonate, (D) 2 to 30% by mass of a thickener, and (E) 0.1 to 20% by mass of a sulfur type extreme-pressure agent are compounded with the lubricant base oil.

The fatty acids constituting the (B) fatty acid salt may be either linear or branched. Though they may be either saturated or unsaturated fatty acids, they are preferably unsaturated fatty acids from the viewpoint of solubility to the lubricant base oil. Though not restricted in particular, the number of unsaturated bonds is preferably 1.

Though not restricted in particular, the fatty acids are preferably those having a carbon number of 10 to 25 from the viewpoint of uniformity in the dispersion of fine particles of carbonate which will be explained later.

Preferred examples of fatty acids used in the present invention include oleic acid (having a carbon number of 18 with a single unsaturated bond), erucic acid (having a carbon number of 22 with a single unsaturated bond), linoleic acid (having a carbon number of 18 with 2 unsaturated bonds), linolenic acid (having a carbon number of 18 with 3 unsaturated bonds), and the like, among which oleic acid is more preferable.

Examples of the fatty acid salt include alkali metal salts, alkaline-earth metal salts, and the like of the above-mentioned fatty acids, among which alkaline-earth metal salts, such as those of magnesium, barium, and calcium are preferred, and calcium salts are more preferable.

Examples of the (C) carbonate include alkali metal salts, alkaline-earth metal salts, and the like, more specifically, lithium salts, sodium salts, potassium salts, magnesium salts, calcium salts, barium salts, and the like, among which alkaline-earth metal salts are preferred, and calcium salts are more preferable.

Carbonates normally exist as fine particles. Though the particle size of carbonate fine particles is not restricted in particular, the average particle size is preferably at least 50 nm, more preferably at least 100 nm, further preferably at least 300 nm, furthermore preferably at least 500 nm, particularly preferably at least 1000 nm, most preferably at least 2000 nm for attaining higher anti-flaking and anti-seizure. Here, the average particle size refers to that measured by a dynamic light-scattering spectrophotometer and calculated by Marquadt method.

Though the mixing ratio between the (B) fatty acid salt and (C) carbonate in the present invention is not restricted in particular, the carbonate is preferably at least 10 parts by weight, more preferably at least 20 parts by weight, further preferably at least 30 parts by weight, particularly preferably at least 40 parts by weight, most preferably at least 50 parts by weight with respect to 100 parts by weight of the fatty acid salt for further improving anti-flaking and anti-seizure. From the viewpoint of solubility to the base oil, the carbonate is preferably not greater than 1000 parts by weight, more preferably not greater than 500 parts by weight, further preferably not greater than 400 parts by weight, furthermore preferably not greater than 300 parts by weight, particularly preferably not greater than 200 parts by weight with respect to 100 parts by weight of the fatty acid.

When compounding the (B) fatty acid salt and (C) carbonate with the lubricant base oil, it is preferred that the carbonate be dispersed by the fatty acid salt so as to be compounded as a mixture (hereinafter referred to as "carbonate-dispersed overbasic fatty acid") forming a complex in which the fatty acid salt is overbased by the carbonate. Namely, when the carbonate is dispersed into the fatty acid salt, a complex in which the fatty acid salt is overbased by the carbonate is formed, whereby their dispersion uniformity and solubility to the lubricant base oil are enhanced by using such a mixture. As a consequence, when the mixture forming such a complex is compounded into the lubricant base oil, anti-flaking and anti-seizure of the grease composition can further be improved.

The carbonate-dispersed overbasic fatty acid can be made, for example, by blowing a carbonic acid gas into a system in which the fatty acid salt is dissolved in a carrier oil while an alkali metal base, an alkaline-earth metal base, and the like exist therein. As such a carrier oil, the mineral oils, synthetic oils, and the like exemplified in the explanation of the lubricant base oil can be used.

Examples of the alkali metal and alkaline-earth metal bases include hydroxides, oxides, and the like. More specific examples are calcium hydroxide, calcium oxide, magnesium oxide, barium oxide, and the like. For accelerating the generation of carbonate fine particles, methanol may be added to the reaction system in the making method mentioned above.

While the carbonate-dispersed overbasic fatty acid is normally obtained in a state dissolved in a carrier oil, the compounding amount of carrier oil is preferably at least 10 parts by weight, more preferably at least 15 parts by weight, further preferably at least 20 parts by weight, particularly preferably at least 25 parts by weight with respect to the 100 parts by weight of the total amount of fatty acid salt and carbonate from the viewpoint of solubility to the base oil. The compounding amount of carrier oil is normally not greater than 1000 parts by weight, preferably not greater than 700 parts by weight, more preferably not greater than 500 parts by weight, further preferably not greater than 400 parts by weight with respect to 100 parts by weight of the total amount of fatty acid salt and carbonate.

Since the fatty acid salt is overbased by the dispersion of carbonate as mentioned above, the carbonate-dispersed overbasic fatty acid exhibits a predetermined total base number (TBN). Though not restricted in particular, the total base number of carbonate-dispersed overbasic fatty acid is preferably at least 50 mg KOH/g, more preferably at least 100 mg KOH/g, further preferably at least 150 mg KOH/g, particularly preferably at least 200 mg KOH/g, more particularly preferably at least 250 mg KOH/g in a state dissolved in the carrier oil for improving anti-flaking and anti-seizure. Though not restricted in particular, the upper limit of the total base number is normally not greater than 600 mg KOH/g. Here, the total base number refers to that (mg KOH/g) measured by the perchloric acid method in compliance with "6." of JIS K 2501 "Petroleum Products and Lubricant Oils—Neutralization Test Methods".

Based on the total amount of grease composition, the sum of contents of (B) fatty acid salt and (C) carbonate is preferably at least 0.05% by mass, more preferably at least 0.1% by mass. When the sum of contents is less than 0.05% by mass, anti-flaking and anti-seizure of the grease composition tend to be insufficient. Based on the total amount of grease composition, the sum of contents is preferably not greater than 15% by mass, more preferably not greater than 10% by mass, further preferably not greater than 5% by mass. Even when the sum of contents exceeds 15% by mass, anti-flaking and anti-seizure do not tend to improve correspondingly thereto. Here, the sum of contents does not include the content of carrier oil and the like.

In addition to the (B) fatty acid salt and (C) carbonate, other organic acid salts such as sulfonate may further be compounded in the present invention. In this case, the other organic acid salts may be compounded separately from the fatty acid salt and carbonate, or the other organic acid salts and the fatty acid salt may be mixed, the carbonate may be dispersed by the resulting mixture, and thus obtained mixture may be compounded as the mixture forming a complex overbased by the carbonate.

The (D) thickener is not restricted in particular, whereby soap thickeners such as metal soaps and complex metal soaps; and nonsoap thickeners such as bentonite, silica gel, urea compounds, urea/urethane compounds, and urethane compounds are usable, among which urea compounds, urea/urethane compounds, urethane compounds, or their mixtures are preferable from the viewpoint of heat resistance.

Specific examples of soap thickeners include sodium soap, calcium soap, aluminum soap, lithium soap, and the like.

Specific examples of urea compounds, urea/urethane compounds, and urethane compounds include diurea compounds, triurea compounds, tetraurea compounds, polyurea compounds having a polymerization degree of at least 5, urea/urethane compounds, diurethane compounds, their mixtures, and the like, among which diurea compounds, urea/urethane compounds, diurethane compounds, and their mixtures are preferred. More preferably, a single compound represented by the following general formula (1):

$$\text{A-CONH—}R^1\text{—NHCO—B} \quad (1)$$

wherein $R^1$ is a bivalent hydrocarbon group, and A and B may be identical or different, each indicating any of —$NHR^2$, —$NR^3R^4$, and $OR^5$ (where $R^2$, $R^3$, $R^4$, and $R^5$ may be identical or different, each indicating a hydrocarbon moiety with a carbon number of 6 to 20), or a mixture of at least two kinds of compounds each represented by the above-mentioned general formula (2) is used. Here, the compound represented by general formula (1) is a diurea compound when both of A and B therein are —$NHR^2$ or $NR^3R^4$; a urea/urethane compound when one of A and B is —$NHR^2$ or $NR^3R^4$ whereas the other is —$OR^5$; and a diurethane compound when both of A and B are —$OR^5$.

Examples of the bivalent hydrocarbon group represented by $R^1$ include linear or branched alkylene groups, linear or branched alkenylene groups, cycloalkylene groups, aromatic groups, and the like, whereas the carbon number of such a hydrocarbon group is preferably 6 to 20, particularly preferably 6 to 15. Preferred examples of $R^1$ include ethylene group, 2,2-dimethyl-4-methylhexylene group, and the groups represented by the following formulae (2) to (10), among which those represented by formulae (3) and (5) are particularly preferred:

(2)

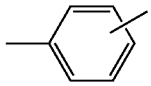

(3)

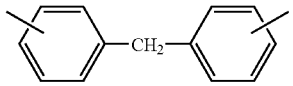

(4)

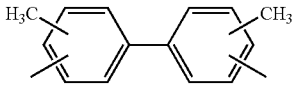

(5)

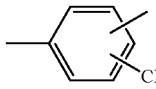

(6)

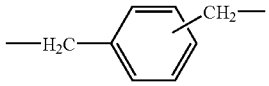

(7)

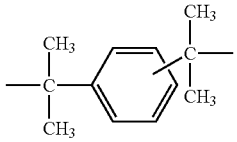

(8)

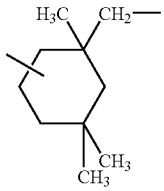

(9)

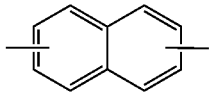

(10)

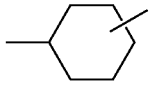

Examples of $R^2$, $R^3$, $R^4$, and $R^5$ include linear or branched alkyl groups, linear or branched alkenyl groups, cycloalkyl groups, alkylcycloalkyl groups, aryl groups, alkylaryl groups, arylalkyl groups, and the like. Specific examples include linear or branched alkyl groups such as hexyl group, heptyl group, octyl group, nonyl group, decyl group, undecyl group, dodecyl group, tridecyl group, tetradecyl group, pentadecyl group, hexadecyl group, heptadecyl group, octadecyl group, nonadecyl group, and eicosyl group; linear or branched alkenyl groups such as hexenyl group, heptenyl group, octenyl group, nonenyl group, decenyl group, undecenyl group, dodecenyl group, tridecenyl group, tetradecenyl group, pentadecenyl group, hexadecenyl group, heptadecenyl group, octadecenyl group, nonadecenyl group, and eicosenyl group; cyclohexyl groups; alkylcyclohexyl groups such as methylcyclohexyl group, dimethylcyclohexyl group, ethylcyclolhexyl group, diethylcyclohexyl group, propylcyclohexyl group, isopropylcyclohexyl group, 1-methyl-3-propylcyclohexyl group, butylcyclohexyl group, amylcyclohexyl group, amylmethylcyclohexyl group, hexylcyclohexyl group, heptylcyclohexyl group, octylcyclohexyl group, nonylcyclohexyl group, decylcyclohexyl group, undecylcyclohexyl group, dodecylcyclohexyl group, tridecylcyclohexyl group, and tetradecylcyclohexyl group; aryl groups such as phenyl group and naphthyl group; alkylaryl groups such as toluyl group, ethylphenyl group, xylyl group, propylphenyl group, cumenyl group, methylnaphthyl group, ethylnaphthyl group, dimethylnaphthyl group, and propylnaphthyl group; arylalkyl groups such as benzyl group, methylbenzyl group, and ethylbenzyl group; and the like, among which cyclohexyl group, octadecyl group, and toluyl group are preferred in particular.

The urea compounds, urea/urethane compounds, or diurethane compounds are made, for example, by causing a diisocyanate represented by the general formula of OCN—$R^1$—NCO to react with a compound represented by the general formula of $NH_2R^2$, $NHR^3R^4$, or $R^50H$ or a mixture of the compounds represented thereby in the base oil at a temperature of 10 to 200° C. Here, $R^1$, $R^2$, $R^3$, $R^4$, and $R^5$ are the same as those in general formula (1).

The content of (D) thickener is at least 2% by mass, preferably at least 5% by mass, based on the total amount of grease composition. If the thickener content is less than 2% by mass, the effect of thickener will be so low that the composition may fail to become fully greasy. On the other hand, the thickener content is not greater than 30% by mass, preferably not greater than 20% by mass, based on the total amount of grease composition. If the content exceeds 30% by mass, the resulting grease composition will be too hard to exhibit a sufficient lubricating performance.

Examples of the (E) sulfur type extreme-pressure agent include the following compounds (E-1) to (E-9):

(E-1) dihydrocarbylpolysulfides
(E-2) sulfuric esters
(E-3) sulfuric mineral oils
(E-4) zinc dithiophosphate compounds
(E-5) zinc dithiocarbamate compounds
(E-6) molybdenum dithiophosphate compounds
(E-7) molybdenum dithiocarbamate compounds
(E-8) thiazole compounds
(E-9) thiadiazole compounds The (E-1) dihydrocarbylpolysulfides are sulfur type compounds generally referred to as polysulfides or olefin sulfides, among which those represented by the following general formula (11) are preferable:

$$R^6—S_x—R^7 \quad (11)$$

where $R^6$ and $R^7$ maybe identical or different, each indicating a linear or branched alkyl group having a carbon number of 3 to 20, an aryl group having a carbon number of 6 to 20, an alkylaryl group having a carbon number of 6 to 20, or an arylalkyl group having a carbon number of 6 to 20, and x is an integer of 2 to 6 (preferably 2 to 5).

Specific examples of the alkyl group represented by $R^6$ and $R^7$ in general formula (11) include n-propyl group, isopropyl group, n-butyl group, isobutyl group, sec-butyl group, tert-butyl group, linear or branched pentyl group, linear or branched hexyl group, linear or branched heptyl group, linear or branched octyl group, linear or branched nonyl group, linear or branched decyl group, linear or branched undecyl group, linear or branched dodecyl group, linear or branched tridecyl group, linear or branched tetradecyl group, linear or branched pentadecyl group, linear or branched hexadecyl group, linear or branched heptadecyl group, linear or branched octadecyl group, linear or branched nonadecyl group, and liner or branched icosyl group.

Specific examples of the aryl group represented by $R^6$ and $R^7$ include phenyl group, naphthyl group, and the like.

Specific examples of the alkylaryl group represented by $R^6$ and $R^7$ include tolyl group (including all the structural isomers thereof), ethylphenyl group (including all the structural isomers thereof), linear or branched propylphenyl group (including all the structural isomers thereof), linear or branched butylphenyl group (including all the structural isomers thereof), linear or branched pentylphenyl group (including all the structural isomers thereof), linear or branched hexylphenyl group (including all the structural isomers thereof), linear or branched heptylphenyl group (including all the structural isomers thereof), linear or branched octylphenyl group (including all the structural isomers thereof), linear or branched nonylphenyl group (including all the structural isomers thereof), linear or branched decylphenyl group (including all the structural isomers thereof), linear or branched undecylphenyl group (including all the structural isomers thereof), linear or branched dodecylphenyl group (including all the structural isomers thereof), linear or branched xylyl group (including all the structural isomers thereof), ethylmethylphenyl group (including all the structural isomers thereof), diethylphenyl group (including all the structural isomers thereof), di(linear or branched) propylphenyl group (including all the structural isomers thereof), di(linear or branched) butylphenyl group (including all the structural isomers thereof), methylnaphthyl group (including all the structural isomers thereof), ethylnaphthyl group (including all the structural isomers thereof), linear or branched propylnaphthyl group (including all the structural isomers thereof), linear or branched butylnaphthyl group (including all the structural isomers thereof), dimethylnaphthyl group (including all the structural isomers thereof), ethylmethylnaphthyl group (including all the structural isomers thereof), diethylnaphthyl group (including all the structural isomers thereof), di(linear or branched) propylnatphthyl group (including all the structural isomers thereof), di(linear or branched) butylnaphthyl group (including all the structural isomers thereof), and the like.

Specific examples of the arylalkyl group represented by $R^6$ and $R^7$ include benzyl group, phenylethyl group (including all the structural isomers thereof), phenylpropyl group (including all the structural isomers thereof), and the like.

Preferred among them are an alkyl group having a carbon number of 3 to 18, an aryl group having a carbon number of 6 to 8, an alkylaryl group having a carbon number of 7 or 8, and an arylalkyl group having a carbon number of 7 or 8, whose $R^6$ and $R^7$ are each derived from propylene, 1-butene, or isobutylene.

More specific preferred examples of the alkyl group include isopropyl group, branched hexyl group (including all the branched isomers thereof) derived from propylene dimer, branched nonyl group (including all the branched isomers thereof) derived from propylene trimer, branched dodecyl group (including all the branched isomers thereof) derived from propylene tetramer, branched pentadecyl group (including all the branched isomers thereof) derived from propylene pentamer, branched octadecyl group (including all the branched isomers thereof) derived from propylene hexamer, sec-butyl group, tert-butyl group, branched octyl group (including all the branched isomers thereof) derived from 1-butene dimer, branched octyl group (including all the branched isomers thereof) derived from isobutylene diner, branched dodecyl group (including all the branched isomers thereof) derived from 1-butene trimer, branched dodecyl group (including all the branched isomers thereof) derived from isobutylene trimer, branched hexadecyl group (including all the branched isomers thereof) derived from 1-butene tetramer, branched hexadecyl group (including all the branched isomers thereof) derived from isobutylene tetramer, and the like.

Preferred examples of aryl group include phenyl group and the like; preferred examples of alkylaryl group include tolyl group (including all the structural isomers thereof), ethylphenyl group (including all the structural isomers thereof), xylyl group (including all the structural isomers thereof), and the like; and preferred examples of arylalkyl group include benzyl group, phenethyl group (including all the structural isomers thereof), and the like.

Further, from the viewpoint of superior anti-flaking and anti-seizure, $R^6$ and $R^7$ are more preferably distinct alkyl groups each having a carbon number of 3 to 18 separately derived from ethylene or propylene, particularly preferably branched alkyl groups each having a carbon number of 6 to 15 derived from ethylene or propylene.

Though not restricted in particular, the sulfur content in the dihydrocarbylpolysulfide used is normally 10 to 55% by mass, preferably 20 to 50% by mass, from the viewpoint of anti-flaking and anti-seizure.

Specific examples of the (E-2) sulfuric ester include animal/vegetable fats and oils such as beef tallow, lard, fish fat, rapeseed oil, soybean oil, and the like; unsaturated fatty acid esters obtained by causing unsaturated fatty acids (including oleic acid, linoleic acid, fatty acids extracted from the above-mentioned animal/vegetable oils and fats, and the like) to react with various alcohols; and those obtained by sulfurizing their mixtures and the like by a given method.

Though not restricted in particular, the sulfur content in the sulfuric ester used is normally 2 to 40% by mass, preferably 5 to 35% by mass, from the view point of anti-flaking and anti-seizure.

The (E-3) sulfuric mineral oil refers to one obtained when elementary sulfur is dissolved in a mineral oil. Though the mineral oil used in the present invention is not restricted in particular, specific examples thereof include those exemplified in the explanation of the lubricant base oil. As the elementary sulfur, any form of mass, powder, liquid melt, and the like may be used, among which the one in powder or liquid melt form is preferred since it can efficiently be dissolved in the base oil. Using elementary sulfur in a liquid melt form is advantageous in that the dissolving operation can be effected in a very short period of time, since liquids are mixed together. However, it necessitates special apparatus such as heating equipment since the elementary sulfur must be treated at a temperature higher than its melting point, and the handling is not always easy in such a high-temperature atmosphere accompanying a danger. By contrast, elementary sulfur in powder form is particularly preferable, since it is inexpensive and easy to handle, while its dissolution time is sufficiently short.

Though not restricted in particular, the sulfur content in the sulfuric mineral oil is preferably 0.05 to 1.0% by mass, more preferably 0.1 to 0.5% by mass, based on the total amount of sulfuric mineral oil.

The (E-4) zinc dithiophosphate compound, (E-5) zinc dithiocarbamate compound, (E-6) molybdenum dithiophosphate compound, and (E-7) molybdenum dithiocarbamate compound are respectively represented by the following general formulae 5 (12) to (15):

(12)

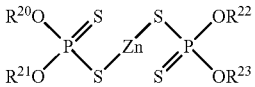

(13)

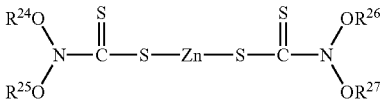

(14)

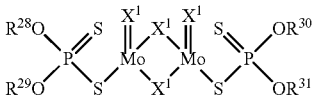

(15)

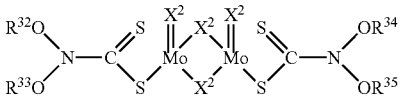

In general formulae (12) to (15), $R^{20}$, $R^{21}$, $R^{22}$, $R^{23}$, $R^{24}$, $R^{25}$, $R^{26}$, $R^{27}$, $R^{28}$, $R^{29}$, $R^{30}$, $R^{31}$, $R^{32}$, $R^{33}$, $R^{34}$, and $R^{35}$ may be identical or difficult, each indicating a hydrocarbon group having a carbon number of at least 1, and $X^1$ and $X^2$ each indicate an oxygen atom or sulfur atom.

Examples of the hydrocarbon group expressed by $R^{20}$ to $R^{35}$ are an alkyl group having a carbon number of 1 to 24, a cycloalkyl group having a carbon number of 5 to 7, an alkylcycloalkyl group having a carbon number of 6 to 11, an aryl group having a carbon number of 6 to 18, an alkylaryl group having a carbon number of 7 to 24, and an arylalkyl group having a carbon number of 7 to 12.

Specific examples of such an alkyl group include methyl group, ethyl group, propyl group (including all the branched isomers thereof), butyl group (including all the branched isomers thereof), pentyl group (including all the branched isomers thereof), hexyl group (including all the branched isomers thereof), heptyl group (including all the branched isomers thereof), octyl group (including all the branched isomers thereof), nonyl group (including all the branched isomers thereof), decyl group (including all the branched isomers thereof), undecyl group (including all the branched isomers thereof), dodecyl group (including all the branched isomers thereof), tridecyl group (including all the branched isomers thereof), tetradecyl group (including all the branched isomers thereof), pentadecyl group (including all the branched isomers thereof), hexadecyl group (including all the branched isomers thereof), heptadecyl group (including all the branched isomers thereof), octadecyl group (including all the branched isomers thereof), nonadecyl group (including all the branched isomers thereof), icosyl group (including all the branched isomers thereof), henicosyl group (including all the branched isomers thereof), docosyl group (including all the branched isomers thereof), tricosyl group (including all the branched isomers thereof), tetracosyl group (including all the branched isomers thereof), and the like.

Specific examples of the cycloalkyl group include cyclopentyl group, cyclohexyl group, cycloheptyl group, and the like.

Specific examples of the alkylcycloalkyl group include methylcyclopentyl group (including all the substituted isomers thereof), ethylcyclopentyl group (including all the substituted isomers thereof), dimethylcyclopentyl group (including all the substituted isomers thereof), propylcyclopentyl group (including all the branched and substituted isomers thereof), methylethylcyclopentyl group (including all the substituted isomers thereof), trimethylcyclopentyl group (including all the substituted isomers thereof), butylcyclopentyl group (including all the branched and substituted isomers thereof), methylpropylcyclopentyl group (including all the branched and substituted isomers thereof), diethylcyclopentyl group (including all the substituted isomers thereof), dimethylethylcyclopentyl group (including all the substituted isomers thereof), methylcyclohexyl group (including all the substituted isomers thereof), ethylcyclohexyl group (including all the substituted isomers thereof), dimethylcyclohexyl group (including all the substituted isomers thereof), propylcyclohexyl group (including all the branched and substituted isomers thereof), methylethylcyclohexyl group (including all the substituted isomers thereof), trimethylcyclohexyl group (including all the substituted isomers thereof), butylcyclohexyl group (including all the branched and substituted isomers thereof), methylpropylcyclohexyl group (including all the branched and substituted isomers thereof), diethylcyclohexyl group (including all the substituted isomers thereof), dimethylcyclohexyl group (including all the substituted isomers thereof), methylcycloheptyl group (including all the substituted isomers thereof), ethylcycloheptyl group (including all the substituted isomers thereof), dimethylcycloheptyl group (including all the substituted isomers thereof), propylcycloheptyl group (including all the branched and substituted isomers thereof), methylethylcycloheptyl group (including all the substituted isomers thereof), trimethylcycloheptyl group (including all the substituted isomers thereof), butylcycloheptyl group (including all the branched and substituted isomers thereof), methylpropylcycloheptyl group (including all the branched and substituted isomers thereof), diethylcycloheptyl group (including all the substituted isomers thereof), dimethylethylcycloheptyl group (including all the substituted isomers thereof), and the like.

Examples of the aryl group include phenyl group, naphthyl group, and the like.

Examples of the alkylaryl group include tolyl group (including all the substituted isomers thereof), xylyl group (including all the substituted isomers thereof), ethylphenyl group (including all the substituted isomers thereof), propylphenyl group (including all the branched and substituted isomers thereof), methylethylphenyl group (including all the substituted isomers thereof), trimethylphenyl group (including all the substituted isomers thereof), butylphenyl group (including all the branched and substituted isomers thereof), methylpropylphenyl group (including all the branched and substituted isomers thereof), diethylphenyl group (including all the substituted isomers thereof), dimethylethylphenyl group (including all the substituted isomers thereof), pentylphenyl group (including all the branched and substituted isomers thereof), hexylphenyl group (including all the branched and substituted isomers thereof), heptylphenyl group (including all the branched and substituted isomers thereof), octylphenyl group (including all the branched and substituted isomers thereof), nonylphenyl group (including all the branched and substituted isomers thereof), decylphenyl group (including all the branched and substituted isomers thereof), undecylphenyl group (including all the branched and substituted isomers thereof), dodecylphenyl group (including all the branched and substituted isomers thereof), tridecylphenyl group (including all the branched and substituted isomers thereof), tetradecylphenyl group (including all the branched and substituted isomers thereof), pentadecylphenyl group (including all the branched and substitute disomers thereof), hexadecylphenyl group (including all the branched and substituted isomers thereof), heptadecylphenyl group (including all the branched and substituted isomers thereof), octadecylphenyl group (including all the branched and substituted isomers thereof), and the like.

Examples of the arylalkyl group include benzyl group, phenethyl group, phenylpropyl group (including all the branched isomers thereof), phenylbutyl group (including all the branched isomers thereof), and the like.

Preferably used as the (E-8) thiazole compound are compounds represented by the following general formulae (16) and (17):

(16)

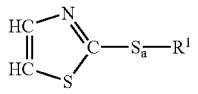

(17)

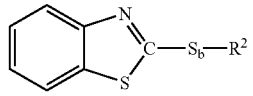

wherein $R^1$ and $R^2$ are each a hydrogen atom, a hydrocarbon group having a carbon number of 1 to 30, or an amino group, $R^3$ is a hydrogen atom or an alkyl group having a carbon number of 1 to 4, and a and b are each an integer of 0 to 3.

Among such thiazole compounds, one represented by the above-mentioned general formula (17) is particularly preferred. Here, while $R^2$ in general formula (17) indicates a hydrogen atom, a hydrocarbon group having a carbon number of 1 to 30, or an amino group as mentioned above, $R^2$ is preferably a hydrogen atom or a hydrocarbon group having a carbon number of 1 to 18, more preferably a hydrogen atom or a hydrocarbon group having a carbon number of 1 to 12.

While $R^3$ in general formula (17) indicates a hydrogen atom or an alkyl group having a carbon number of 1 to 4 as mentioned above, $R^3$ is preferably a hydrogen atom or an alkyl group having a carbon number of 1 to 3, more preferably a hydrogen atom or a hydrocarbon group having a carbon number of 1 or 2.

While b in general formula (17) indicates an integer of 0 to 3 as mentioned above, b is preferably 0 to 2.

Specific examples of such a benzothiazole compound include benzothiazole, 2-mercaptobenzothiazole, 2-(hexyldithio)benzothiazole, 2-(octyldithio)benzothiazole, 2-(decyldithio)benzothiazole, 2-(dodecyldithio)benzothiazole, 2-(N,N-diethyldithiocarbamyl)benzothiazole, and the like.

Preferably used as the (E-9) thiazole compound are a 1,3,4-thiadiazole compound represented by the following general formula (18), a 1,2,4-thiadiazole compound represented by the following general formula (19), and a 1,4,5-thiadiazole compound represented by the following general formula (20):

(18)

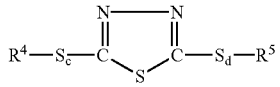

-continued (19)

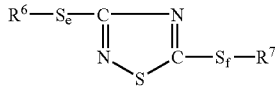

(20)

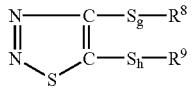

wherein $R^4$, $R^5$, $R^5$, $R^7$ $R^8$, and $R^9$ may be identical or different, each indicating a hydrogen atom or a hydrocarbon group having a carbon number of 1 to 20, and c, d, e, f, g, and h may be identical or different, each indicating an integer of 0 to 8.

Here, while $R^4$, $R^5$, $R^1$, $R^7$, $R^8$, and $R^9$ in the above-mentioned general formulae (18) to (20) each indicate a hydrogen atom or a hydrocarbon group having a carbon number of 1 to 20 as mentioned above, each of them is preferably a hydrogen atom or a hydrocarbon group having a carbon number of 1 to 18, more preferably a hydrogen atom or a hydrocarbon group having a carbon number of 1 to 12.

While c, d, e, f, g, and h in general formulae (18) to (20) each indicate an integer of 0 to 3 as mentioned above, each of them is preferably an integer of 0 to 2.

Specific examples of such a thiadiazole compound include 2,5-bis(n-hexyldithio)-1,3,4-thiadiazole, 2,5-bis(n-octyldithio)-1,3,4-thiadiazole, 2,5-bis(n-nonyldithio)-1,3,4-thiadiazole, 2,5-bis(1,1,3,3-tetramethylbutyldithio)-1,3,4-thiadiazo le, 3,5-bis(n-hexyldithio)-1,2,4-thiadiazole, 3,5-bis(n-octyldithio)-1,2,4-thiadiazole, 3,5-bis(n-nonyldithio)-1,2,4-thiadiazole, 3,5-bis(1,1,3,3-tetramethylbutyldithio)-1,2,4-thiadiazo le, 4,5-bis(n-hexyldithio)-1,2,3-thiadiazole, 4,5-bis(n-octyldithio)-1,2,3-thiadiazole, 4,5-bis(n-nonyldithio)-1,2,3-thiadiazole, 4,5-bis(1,1,3,3-tetramethylbutyldithio)-1,2,3-thiadiazo le, and the like.

Among the above-mentioned (E-1) to (E-9), (E-1) and/or (E-2) is more preferably used from the viewpoint of anti-flaking and anti-seizure.

The content of sulfur type extreme-pressure agent is at least 0.1% by mass, preferably at least 0.5% by mass, based on the total amount of grease composition. If the content is less than 0.1% by mass, anti-flaking and anti-seizure become insufficient. On the other hand, the content of sulfur type extreme-pressure agent is not greater than 20% by mass, preferably not greater than 10% by mass, based on the total amount of grease composition. Even if the content exceeds 20% by mass, anti-flaking and anti-seizure will not improve correspondingly thereto.

The grease composition of the present invention may further contain solid lubricants, extreme-pressure agents, antioxidants, oil agents, rust-preventive agents, viscosity index improvers, and the like in addition to the above-mentioned ingredients (A) to (E) when necessary as long as its characteristics are not deteriorated thereby.

Specific examples of the solid lubricants include graphite, graphite fluoride, polytetrafluoroethylene, molybdenum disulfide, antimony sulfide, alkaline (earth) metal borate, and the like.

Specific examples of the extreme-pressure agents include phosphates, phosphites, and the like.

Specific examples of the antioxidants include phenol compounds such as 2,6-di-t-butylphenol and 2,6-di-t-butylp-cresol; amine compounds such as dialkyldiphenylamine, phenyl-α-naphthylamine, and p-alkylphenyl-α-naphthylamine; sulfur compounds; phenothiazine compounds; and the like.

Specific examples of the oil agents include amines such as laurylamine, myristylamine, palmitylamine, stearylamine, and oleyl amine; higher alcohols such as lauryl alcohol, myristyl alcohol, palmityl alcohol, stearyl alcohol, and oleyl alcohol; higher fatty acids such as lauric acid, myristic acid, palmitic acid, stearic acid, and oleic acid; fatty acid esters such as methyl laurate, methyl myristate, methyl palmitate, methyl stearate, and methyl oleate; amides such as laurylamide, myristylamide, palmitylamide, stearylamide, and oleylamide; oils and fats; and the like.

Specific examples of rust-preventive agents include metal soaps; polyvalent alcohol partial esters such as sorbitan fatty acid esters; amines; phosphoric acid; phosphates; and the like.

Specific examples of the viscosity index improvers include polymethacrylate, polyisobutylene, polystyrene, and the like.

The grease composition of the present invention can be obtained, for example, by mixing the (A) lubricant base oil with the above-mentioned ingredients (B) to (E) (in which (B) and (C) are preferably carbonate-dispersed overbasic fatty acids) and, if necessary, other additives, stirring the mixture, and passing thus obtained mixture through a roll mill or the like. Alternatively, it can be made by adding raw material ingredients of a thickener to a base oil, melting them, stirring the mixture so as to generate the thickener in the base oil, then stirring and mixing it with the ingredients (B), (C), and (E), as well as other additives when necessary, and passing thus obtained mixture through a roll mill or the like.

The grease composition of the present invention is excellent in anti-flaking, anti-seizure, anti-wear, and the like, thus being useful as a grease for constant velocity joints, constant velocity gears, variable velocity gears, iron-making equipment, and the like. In particular, when used as a grease for constant velocity joints such as fixed type joints like Barfield joint, Rzeppa joint, and undercutting free joint; and slide type constant velocity joints like double-offset joint, tripod joint, cross-groove joint, and the like, the grease composition of the present invention can exhibit excellent effects, thus being able to achieve a sufficiently long life even in the case where the apparatus attains a higher speed, smaller size, and lighter weight.

EXAMPLES

In the following, the present invention will be explained further in detail with reference to Examples and Comparative Examples, which do not restrict the present invention at all.

Examples 1 to 18 and Comparative Examples 1 to 3

Preparation of Grease Composition

In Examples 1 to 18 and Comparative Examples 1 to 3, while a solvent-refined paraffin type mineral oil (having a kinematic viscosity of 126 $mm^2/s$ at 40° C.) was used as a lubricant base oil, the carbonate-dispersed overbasic fatty acids, thickener materials, sulfur type extreme-pressure agents, and antioxidants listed in the following were compounded therewith, so as to prepare grease compositions.

In Examples 1 to 18 and Comparative Examples 1 to 3, thickener materials 1 to 4, which will be explained later, were used so as to generate thickeners in the lubricant base oil. Namely, in Examples 1 to 5, 7 to 11, and 13 to 17, and Comparative Examples 1 to 3, a mixture in which diphenylmethane 4,4'-diisocyanate was dissolved in the solvent-refined paraffin type mineral oil by heating and a mixture in which predetermined amine and/or alcohol was dissolved in the solvent-refined paraffin type mineral oil by heating were mixed together so as to generate a thickener. In Examples 6, 12, and 18, thickener material 4 was dissolved in the solvent-refined paraffin type mineral oil by heating, so as to generate a thickener.

Subsequently, carbonate-dispersed overbasic fatty acids, thickeners, sulfur type extreme-pressure agents, and antioxidants were added to and stirred with the lubricant base oil containing such a thickener, and the resulting mixtures were passed through a roll mill, whereby grease compositions were obtained.

In Examples 6, 12, and 18, on the other hand, thickener material 4 was added to and stirred with the solvent-refined paraffin type mineral oil together with carbonate-dispersed overbasic fatty acids, thickeners, sulfur type extreme-pressure agents, and antioxidants, and the resulting mixtures were passed through a roll mill, whereby grease compositions were obtained.

(Carbonate-Dispersed Overbasic Fatty Acid)

Carbonate-dispersed overbasic fatty acid 1: calcium oleate overbased by calcium carbonate (comprising 42% by mass of calcium oleate, 15.9% by mass of calcium carbonate, and 42.1% by mass of solvent-refined paraffin type mineral oil; while having an average calcium carbonate particle size of 717 nm and a total base number of 258 mg KOH/g)

Carbonate-dispersed overbasic fatty acid 2: calcium salt of a mixed fatty acid (an equimolar mixture of oleic acid and linoleic acid) overbased by calcium carbonate (comprising 29.6% by mass of the fatty acid calcium salt, 40.8% by mass of calcium carbonate, and 29.6% by mass of solvent-refined paraffin type mineral oil; while having an average calcium carbonate particle size of 306 nm and a total base number of 513 mg KOH/g) Carbonate-dispersed overbasic fatty acid 3: calcium salt of a mixed fatty acid (an equimolar mixture of oleic acid and isostearic acid) overbased by calcium carbonate (comprising 35.8% by mass of the fatty acid calcium salt, 28.3% by mass of calcium carbonate, and 35.9% by mass of solvent-refined paraffin type mineral oil; while having an average calcium carbonate particle size of 560 nm and a total base number of 385 mg KOH/g)

(Thickener Material)

Thickener material 1: diphenylmethane 4,4'-diisocyanate, cyclohexylamine, and stearylamine (with a mixture ratio (molar ratio) of 5/7/3)

Thickener material 2: diphenylmethane 4,4'-diisocyanate, cyclohexylamine, and octadecyl alcohol (with a mixture ratio (molar ratio) of 5/8/2)

Thickener material 3: diphenylmethane 4,4'-diisocyanate and cyclohexylamine (with a mixture ratio (molar ratio) of 1/2)

Thickener material 4: lithium 12-hydroxystearate

Sulfur Type Extreme-Pressure Agent

The following extreme-pressure agents 1 to 5 were used as extreme-pressure agents.

Extreme-pressure agent 1: dihydrocarbylpolysulfide (polyisobutylene sulfide having a sulfur content of 45% by mass)

Extreme-pressure agent 2: sulfurized fat (sulfurized lard having a sulfur content of 30% by mass)

Extreme-pressure agent 3: molybdenum dithiocarbamate

Extreme-pressure agent 4: molybdenum dithiophosphate

Extreme-pressure agent 5: zinc dithiophosphate Antioxidant

Antioxidant 1: amine type antioxidant

On-Table Durability Test

Using thus obtained grease compositions of Examples 1 to 18 and Comparative Examples 1 to 3, on-table durability tests were conducted, so as to evaluate anti-flaking and anti-seizure. Namely, a commercially-available #87-size Barfield joint was coated with the grease compositions, and tests were carried out under a condition in which a mode changing the number of revolutions, torque, and operating angle in view of a car driving pattern was defined as one cycle, whereby the number of cycles elapsed before the joint was seized or flaking occurred at each part was measured. Tables 1 to 4 show thus obtained results.

TABLE 1

| | EXAMPLE 1 | EXAMPLE 2 | EXAMPLE 3 | EXAMPLE 4 | EXAMPLE 5 | EXAMPLE 6 |
|---|---|---|---|---|---|---|
| BASE OIL [% BY MASS] | 82.0 | 81.0 | 72.0 | 78.0 | 80.0 | 84.0 |
| CARBONATE-DISPERSED OVERBASIC FATTY ACID SALT 1 [% BY MASS] | 1.0 | 2.0 | 1.0 | 2.0 | 1.5 | 1.0 |
| THICKENER [% BY MASS] | 12.0 | 10.0 | 20.0 | 10.0 | 10.0 | 10.0 |
| [THICKENER MATERIAL] | [1] | [2] | [3] | [2] | [2] | [4] |
| EXTREME-PRESSURE AGENT 1 [% BY MASS] | 2.0 | | 2.0 | 2.0 | — | 2.0 |
| EXTREME-PRESSURE AGENT 2 [% BY MASS] | — | 4.0 | — | — | 2.0 | — |
| EXTREME-PRESSURE AGENT 3 [% BY MASS] | — | — | 2.0 | 2.0 | 1.5 | — |
| EXTREME-PRESSURE AGENT 4 [% BY MASS] | — | — | — | 3.0 | — | — |
| EXTREME-PRESSURE AGENT 5 [% BY MASS] | — | — | — | — | 2.0 | — |
| ANTIOXIDANT 1 [% BY MASS] | 3.0 | 3.0 | 3.0 | 3.0 | 3.0 | 3.0 |
| ON-TABLE DURABILITY TEST [CYCLE] | 500 | 525 | 600 | 625 | 575 | 450 |

TABLE 2

| | EXAMPLE 7 | EXAMPLE 8 | EXAMPLE 9 | EXAMPLE 10 | EXAMPLE 11 | EXAMPLE 12 |
|---|---|---|---|---|---|---|
| BASE OIL [% BY MASS] | 82.0 | 81.0 | 72.0 | 78.0 | 80.0 | 84.0 |
| CARBONATE-DISPERSED OVERBASIC FATTY ACID SALT 2 [% BY MASS] | 1.0 | 2.0 | 1.0 | 2.0 | 1.5 | 1.0 |
| THICKENER [% BY MASS] | 12.0 | 10.0 | 20.0 | 10.0 | 10.0 | 10.0 |
| [THICKENER MATERIAL] | [1] | [2] | [3] | [2] | [2] | [4] |
| EXTREME-PRESSURE AGENT 1 [% BY MASS] | 2.0 | | 2.0 | 2.0 | — | 2.0 |
| EXTREME-PRESSURE AGENT 2 [% BY MASS] | — | 4.0 | — | — | 2.0 | — |
| EXTREME-PRESSURE AGENT 3 [% BY MASS] | — | — | 2.0 | 2.0 | 1.5 | — |
| EXTREME-PRESSURE AGENT 4 [% BY MASS] | — | — | — | 3.0 | — | — |
| EXTREME-PRESSURE AGENT 5 [% BY MASS] | — | — | — | — | 2.0 | — |
| ANTIOXIDANT 1 [% BY MASS] | 3.0 | 3.0 | 3.0 | 3.0 | 3.0 | 3.0 |
| ON-TABLE DURABILITY TEST [CYCLE] | 550 | 550 | 625 | 625 | 625 | 475 |

TABLE 3

| | EXAMPLE 13 | EXAMPLE 14 | EXAMPLE 15 | EXAMPLE 16 | EXAMPLE 17 | EXAMPLE 18 |
|---|---|---|---|---|---|---|
| BASE OIL [% BY MASS] | 82.0 | 81.0 | 72.0 | 78.0 | 80.0 | 84.0 |
| CARBONATE-DISPERSED OVERBASIC FATTY ACID SALT 3 [% BY MASS] | 1.0 | 2.0 | 1.0 | 2.0 | 1.5 | 1.0 |
| THICKENER [% BY MASS] | 12.0 | 10.0 | 20.0 | 10.0 | 10.0 | 10.0 |
| [THICKENER MATERIAL] | [1] | [2] | [3] | [2] | [2] | [4] |
| EXTREME-PRESSURE AGENT 1 [% BY MASS] | 2.0 | | 2.0 | 2.0 | — | 2.0 |
| EXTREME-PRESSURE AGENT 2 [% BY MASS] | — | 4.0 | — | — | 2.0 | — |
| EXTREME-PRESSURE AGENT 3 [% BY MASS] | — | — | 2.0 | 2.0 | 1.5 | — |
| EXTREME-PRESSURE AGENT 4 [% BY MASS] | — | — | — | 3.0 | — | — |
| EXTREME-PRESSURE AGENT 5 [% BY MASS] | — | — | — | — | 2.0 | — |

TABLE 3-continued

| | EXAMPLE 13 | EXAMPLE 14 | EXAMPLE 15 | EXAMPLE 16 | EXAMPLE 17 | EXAMPLE 18 |
|---|---|---|---|---|---|---|
| ANTIOXIDANT 1 [% BY MASS] | 3.0 | 3.0 | 3.0 | 3.0 | 3.0 | 3.0 |
| ON-TABLE DURABILITY TEST [CYCLE] | 525 | 525 | 600 | 625 | 600 | 425 |

TABLE 4

| | COMPARATIVE EXAMPLE 1 | COMPARATIVE EXAMPLE 2 | COMPARATIVE EXAMPLE 3 | COMPARATIVE EXAMPLE 4 | COMPARATIVE EXAMPLE 5 |
|---|---|---|---|---|---|
| BASE OIL [% BY MASS] | 85.0 | 84.0 | 84.0 | 84.0 | 83.0 |
| CARBONATE-DISPERSED OVERBASIC FATTY ACID SALT 1 [% BY MASS] | — | 1.0 | — | — | — |
| CARBONATE-DISPERSED OVERBASIC FATTY ACID SALT 2 [% BY MASS] | — | — | 1.0 | — | — |
| CARBONATE-DISPERSED OVERBASIC FATTY ACID SALT 3 [% BY MASS] | — | — | — | 1.0 | — |
| THICKENER [% BY MASS] | 12.0 | 12.0 | 12.0 | 12.0 | 12.0 |
| [THICKENER MATERIAL] | [1] | [1] | [1] | [1] | [1] |
| EXTREME-PRESSURE AGENT 1 [% BY MASS] | — | — | — | — | 2.0 |
| ANTIOXIDANT 1 [% BY MASS] | 3.0 | 3.0 | 3.0 | 3.0 | 3.0 |
| ON-TABLE DURABILITY TEST [CYCLE] | <25 (SEIZED) | <25 (SEIZED) | <25 (SEIZED) | <25 (SEIZED) | 50 |

As shown in Tables 1 to 3, it was verified that the grease compositions of Examples 1 to 18 were excellent in anti-flaking and anti-seizure, and could sufficiently elongate the life of constant velocity joints.

By contrast, as shown in Table 4, seizure in the case where the grease compositions of Comparative Examples 1 to 4 were used, and flaking in the case where the grease composition of Comparative Example 5 was used occurred at early stages.

As explained in the foregoing, the grease composition in accordance with the present invention achieves anti-flaking and anti-seizure at a high level, and can sufficiently elongate the life of constant velocity joints and the like. Also, these effects of the grease composition in accordance with the present invention can be exhibited without using lead compounds, whereby the grease composition of the present invention is quite useful in terms of safety with respect to the human body and environment as well.

What is claimed is:

1. A grease composition containing, in a lubricant base oil, on the basis of the total amount of composition:

0.01 to 10% by mass of a fatty acid salt;

0.01 to 10% by mass of carbonate;

2 to 30% by mass of at least one thickener selected from a metal soap, a complex metal soap, an urea compound, an urea/urethane compound, and an urethane compound; and 0.1 to 20% by mass of a sulfur type extreme-pressure agent;

obtainable by mixing the above components;

wherein the fatty acid salt and the carbonate are compounded as a mixture in which the carbonate is dispersed into the fatty acid salt, said mixture being obtained by blowing a carbonic acid gas into a system in which the fatty acid salt is dissolved in a carrier oil while a base exists therein.

2. A grease composition in a lubricant base oil, produced by the steps of:

providing 0.01 to 10% by mass of a fatty acid salt;

providing 0.01 to 10% by mass of a carbonate;

providing 2 to 30% by mass of at least one thickener selected from a metal soap, a complex metal soap, an urea compound, an urea/urethane compound and an urethane compound;

providing 0.1 to 20% by mass of a sulfur type extreme-pressure agent; and mixing the above components;

wherein the fatty acid salt and the carbonate are compounded as a mixture in which the carbonate is dispersed into the fatty acid salt, said mixture being obtained by blowing a carbonic acid gas into a system in which the fatty acid salt is dissolved in a carrier oil while a base exists therein.

3. A method of preparing a grease composition in a lubricant base oil comprising the steps of:

providing 0.01 to 10% by mass of a fatty acid salt;

providing 0.01 to 10% by mass of carbonate;

providing 2 to 30% by mass of at least one thickener selected from a metal soap, a complex metal soap, an urea compound, an urea/urethane compound, and an urethane compound;

providing 0.1 to 20% by mass of a sulfur-type extreme-pressure agent;

mixing the above components;

compounding the fatty acid salt and the carbonate as a mixture in which the carbonate is dispersed into the fatty acid salt; and blowing a carbonic acid gas into a system in which the fatty acid salt is dissolved in a carrier oil while the base exists therein.

* * * * *

UNITED STATES PATENT AND TRADEMARK OFFICE

CERTIFICATE OF CORRECTION

PATENT NO. : 7,256,163 B2
APPLICATION NO. : 10/300882
DATED : August 14, 2007
INVENTOR(S) : Tamio Akada It is certified that error appears in the above-identified patent and that said Letters Patent is hereby corrected as shown below:

On the Title Page, item (74), line 2, "Garrett, & Dunner" should read --Garrett & Dunner--.

Signed and Sealed this

Twenty-fifth Day of December, 2007

JON W. DUDAS
*Director of the United States Patent and Trademark Office*